US009275581B2

(12) United States Patent
Han

(10) Patent No.: US 9,275,581 B2
(45) Date of Patent: Mar. 1, 2016

(54) PIXEL, DISPLAY DEVICE COMPRISING THE SAME AND DRIVING METHOD THEREOF

(71) Applicant: Samsung Display Co., Ltd., Yongin, Gyeonggi-do (KR)

(72) Inventor: Sang-Myeon Han, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 242 days.

(21) Appl. No.: 13/737,393

(22) Filed: Jan. 9, 2013

(65) Prior Publication Data

US 2014/0071028 A1 Mar. 13, 2014

(30) Foreign Application Priority Data

Sep. 10, 2012 (KR) ..... 10-2012-0100100

(51) Int. Cl.
*G09G 3/32* (2006.01)
*G09G 3/00* (2006.01)

(52) U.S. Cl.
CPC ..... *G09G 3/3266* (2013.01); *G09G 3/003* (2013.01); *G09G 3/3233* (2013.01); *G09G 2300/0819* (2013.01); *G09G 2300/0852* (2013.01); *G09G 2300/0861* (2013.01)

(58) Field of Classification Search
CPC ... G09G 3/3266; G09G 3/003; G09G 3/3233; G09G 2300/0819; G09G 2300/0852; G09G 2300/0861
USPC ..... 345/77, 78, 92, 212, 690
See application file for complete search history.

(56) References Cited

U.S. PATENT DOCUMENTS 6,348,906 B1 * 2/2002 Dawson ..... G09G 3/3233 345/100
7,825,880 B2 * 11/2010 Yumoto ..... G09G 3/3233 345/77
2004/0145547 A1 * 7/2004 Oh ..... 345/76
2005/0052366 A1 * 3/2005 Kim ..... G09G 3/3233 345/76
2005/0285825 A1 * 12/2005 Eom et al. ..... 345/76
2008/0170009 A1 * 7/2008 Eom ..... 345/76
2009/0027312 A1 * 1/2009 Han ..... G09G 3/3233 345/76
2009/0108763 A1 * 4/2009 Han ..... G09G 3/3233 315/169.3
2011/0157135 A1 * 6/2011 Lee et al. ..... 345/211
2011/0227903 A1 * 9/2011 Choi ..... G09G 3/3233 345/212
2012/0147060 A1 * 6/2012 Jeong ..... 345/690
2012/0162275 A1 * 6/2012 Park ..... 345/690

FOREIGN PATENT DOCUMENTS

JP 2012-088714 A 5/2012
KR 10-2008-0095799 A 10/2008
KR 10-2011-0136775 A 12/2011

* cited by examiner

*Primary Examiner* — Temesgh Ghebretinsae
*Assistant Examiner* — Benyam Ketema
(74) *Attorney, Agent, or Firm* — Knobbe, Martens, Olson & Bear, LLP

(57) ABSTRACT

An organic light emitting diode (OLED) display device is disclosed. In one aspect, the device includes a plurality of pixels. Each of the pixels includes 1) a driving transistor controlling a driving current supplied to an OLED, 2) a first capacitor connected to a first electrode of the driving transistor and 3) a switching transistor connecting the first capacitor and the data line. Each pixel further includes a first light emission transistor transmitting a first power source voltage to the first electrode of the driving transistor and a second capacitor connected between the gate electrode of the driving transistor and the first power source voltage. When the first power source voltage is applied to the first electrode of the driving transistor, the corresponding scan signal of a gate-on voltage is supplied and thus the corresponding data voltage is stored in the first capacitor.

29 Claims, 9 Drawing Sheets

PIXEL, DISPLAY DEVICE COMPRISING THE SAME AND DRIVING METHOD THEREOF

CROSS-REFERENCE TO RELATED APPLICATION

This application claims priority to and the benefit of Korean Patent Application No. 10-2012-0100100 filed in the Korean Intellectual Property Office on Sep. 10, 2012, the entire contents of which are incorporated herein by reference.

BACKGROUND (a) Field

The described technology generally relates to a display device and a driving method thereof.

(b) Description of the Related Technology

An organic light emitting diode (OLED) display uses an OLED of which luminance is controlled by a current or a voltage. The OLED generally includes an anode and a cathode layer for forming an electric field, and an organic light emitting material emitting light by the electric field.

Generally, an OLED display is classified into either a passive matrix OLED (PMOLED) or an active matrix OLED (AMOLED) according to how the diodes are driven.

In view of resolution, contrast, and operation speed, the AMOLED that is selectively turned-on for every unit pixel is preferred for most commercial applications. One frame of the active matrix type display device includes a scan period for image data programming and a light emission period for light emission according to the programmed image data.

SUMMARY

One inventive aspect is a pixel including an organic light emitting diode, an active matrix type display device including the pixel, and a driving method thereof.

Another aspect is a pixel a pixel having a structure that is appropriate for enlargement of a display panel, high-resolution, and displaying a stereoscopic image and can assure a sufficient aperture ratio, a display device including the pixel, and a driving method of the display device.

Another aspect is a display device which includes a plurality of pixels, each including a driving transistor that controls a driving current supplied to an organic light emitting diode, a first capacitor connected to a first electrode of the driving transistor, a switching transistor connecting the first capacitor and a data line, and a first light emission transistor transmitting a first power source voltage to the first electrode of the driving transistor, and when light emission of the organic light emitting diode with application of the first power source voltage through the first light emission transistor to the first electrode of the driving transistor is simultaneously occurred in each of the plurality of pixels, a scan signal of a gate-on voltage is applied to the corresponding pixel and thus the corresponding data voltage is stored in the first capacitor.

Each of the plurality of pixels may further include a compensation transistor connecting a gate electrode and a second electrode of the driving transistor.

Each of the plurality of pixels may further include an initialization transistor connected to the gate electrode of the driving transistor.

Each of the plurality of pixels may further include a second light emission transistor connected between the second electrode of the driving transistor and an anode of the organic light emitting diode.

The initialization transistor may include a gate electrode to which the initialization signal is input, a first electrode connected to a data line, and a second electrode connected to the gate electrode of the driving transistor.

When an initialization signal of a gate-on voltage is applied to the gate electrode of the initialization transistor, an initialization voltage may be applied to the data line.

Each of the plurality of pixels may further include a second initialization transistor including a gate electrode to which the initialization signal is applied, a first electrode connected to the first power source voltage, and a second electrode connected to the first electrode of the driving transistor.

The initialization transistor may include a gate electrode to which the initialization signal is input, a first electrode to which an initialization voltage is applied, and a second electrode connected to the gate electrode of the driving transistor.

The display device may further include a second initialization transistor including a gate electrode to which the initialization signal is applied, a first electrode connected to the first power source voltage, and a second electrode connected to the first electrode of the driving transistor.

When a compensation control signal of a gate-on voltage is applied to the gate electrode of the compensation transistor, a sustain voltage may be applied to the data line and a scan signal of a gate-on voltage is applied to the gate electrode of the switching transistor so that the data voltage stored in the first capacitor is transmitted to the first electrode of the driving transistor with reference to the sustain voltage.

The data voltage stored in the first capacitor may be applied to the previous frame of the present frame.

Each of the plurality of pixels may further include a second capacitor connected between the gate electrode of the driving transistor and the first power source voltage.

The compensation transistor may be turned on, and a threshold voltage of the driving transistor and a voltage to which the data voltage of the previous frame may be reflected are stored in the second capacitor.

Another aspect is a method for driving a display device including a plurality of pixels, each including a driving transistor controlling a driving current supplied to an organic light emitting diode, a first capacitor connected to a first electrode of the driving transistor, a switching transistor connecting the first capacitor and the data line, a first light emission transistor transmitting a first power source voltage to the first electrode of the driving transistor, and a second capacitor connected between the gate electrode of the driving transistor and the first power source voltage, the method including a scanning step for storing a data voltage in the first capacitor by applying a scan signal of a gate-on voltage to a gate electrode of the switching transistor and a light emission step for light emission of the organic light emitting diode according to a driving current flowing to the driving transistor by a voltage stored in the second capacitor. The light emission step of the respective pixels may be simultaneously performed, and the scanning step and the light emission step may be temporally overlapped with each other.

The light emission step may include turning on a first light emission transistor that transmits the first power source voltage to a first electrode of the driving transistor and turning on a second light emission transistor connected between a second electrode of the driving transistor and an anode of the organic light emitting diode.

The method may further include an initialization step for transmitting an initialization voltage to a gate electrode of the driving transistor by applying an initialization signal of a gate-on voltage to a gate electrode of an initialization transistor connected to the gate electrode of the driving transistor.

In the initialization step, the initialization transistor may include a first electrode connected to the data line and a second electrode connected to the gate electrode of the driving transistor, and when an initialization signal of a gate-on voltage is applied to the gate electrode of the initialization transistor, the initialization voltage may be applied to the data line.

The initialization step may further include turning on a second initialization transistor that includes a gate electrode to which the initialization signal is applied, a first electrode connected to the first power source voltage, and a second electrode connected to the first electrode of the driving transistor.

In the initialization step, the initialization transistor may include a first electrode to which the initialization voltage is applied and a second electrode connected to the gate electrode of the driving transistor, and an initialization signal of a gate-on voltage may be applied to the gate electrode of the initialization transistor.

The initialization step may further include turning on a second initialization transistor including a gate electrode to which the initialization signal is applied, a first electrode connected to the first power source voltage, and a second electrode connected to the first electrode of the driving transistor.

The method may further include a compensation step for compensating a threshold voltage of the driving transistor by applying a compensation control voltage of a gate-on voltage to a gate electrode of a compensation transistor that connects the gate electrode and the second electrode of the driving transistor.

In the compensation step, when a compensation control signal of a gate-on voltage is applied to the gate electrode of the compensation transistor, a sustain voltage may be applied to the data line and a scan signal of a gate-on voltage is applied to the gate electrode of the switching transistor so that a data voltage stored in the first capacitor is transmitted to the first electrode of the driving transistor with reference to the sustain voltage.

The data voltage stored in the first capacitor may be applied in the previous frame of the present frame.

The compensation step may further include turning on the compensation transistor and storing a voltage to which a threshold voltage of the driving transistor and a voltage to which the data voltage of the previous frame is reflected are stored in the second capacitor.

Another aspect is a pixel which includes: a switching transistor including a gate electrode to which a scan signal is applied and a first electrode connected to a data line; a first capacitor including a first electrode connected to a second electrode of the switching transistor and a second electrode connected to a first node; a driving transistor including a gate electrode connected to a second node, a first electrode connected to the first node, and a second electrode connected to a third node; a compensation transistor including a gate electrode to which a compensation control signal is applied, a first electrode connected to the second node, and a second electrode connected to the third node; an initialization transistor transmitting an initialization voltage to the second node according to an initialization signal; and a second capacitor including a first electrode connected to the second node and a second electrode connected to a first power source voltage.

The pixel may further include: a first light emission transistor including a gate electrode to which a light emission signal is applied, a first electrode connected to the first power source voltage, and a second electrode connected to the first node; and a second light emission transistor including a gate electrode to which the light emission signal is applied, a first electrode connected to the third node, and a second electrode connected to an anode of an organic light emitting diode.

The initialization transistor may include a gate electrode to which the initialization signal is applied, a first electrode connected to the data line, and a second electrode connected to the second node.

The pixel may further include a second initialization transistor including a gate electrode to which the initialization signal is applied, a first electrode connected to the first power source voltage, and a second electrode connected to the first node.

The initialization transistor may include a gate electrode to which the initialization signal is applied, a first electrode connected to an initialization voltage, and a second electrode connected to the second node.

The pixel may further include a second initialization transistor including a gate electrode to which the initialization signal is applied, a first electrode connected to the first power source voltage, and a second electrode connected to the first node.

DETAILED DESCRIPTION

Figure 1:
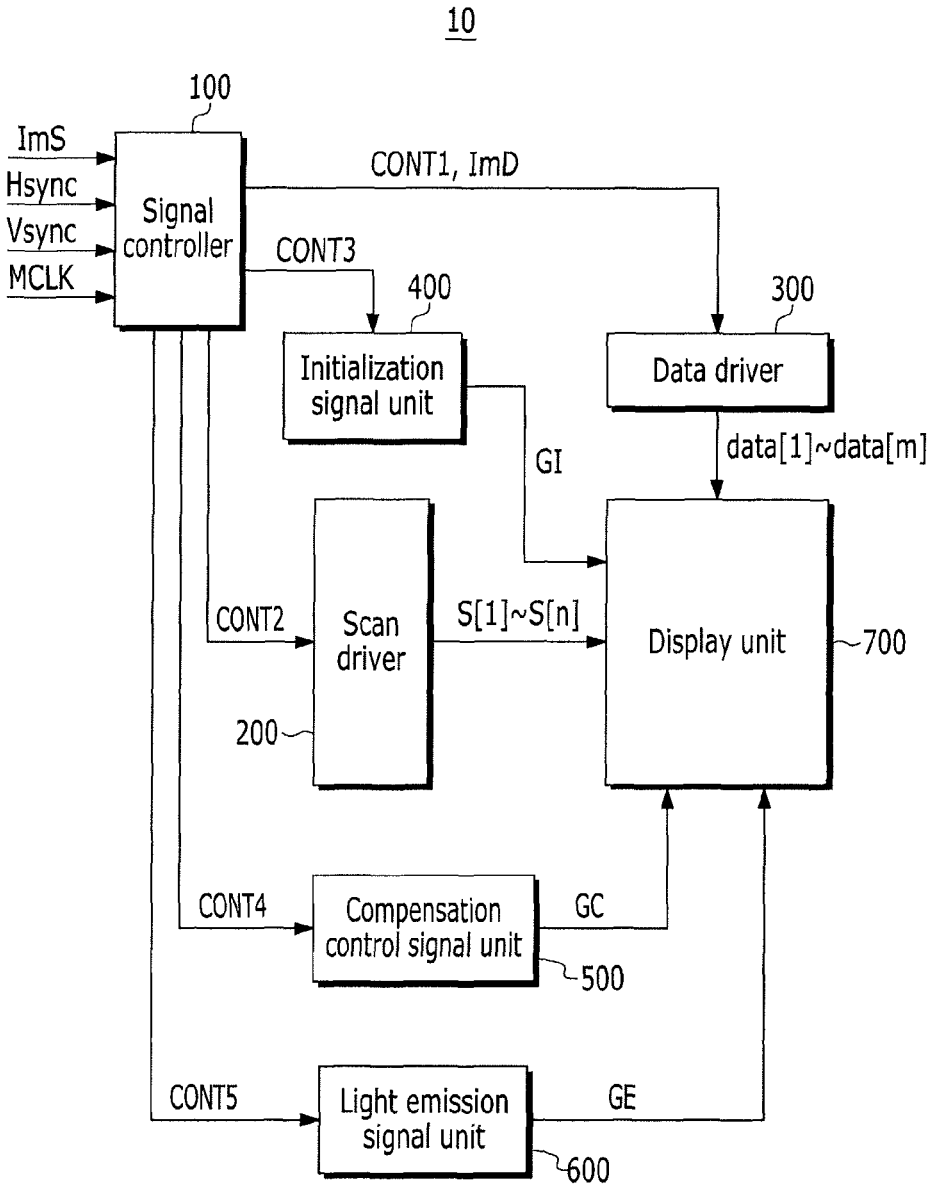
FIG. 1 is a block diagram of a display device according to an embodiment.

Recently, a flat panel display panel has been increased in size with increasing resolution. As the display panel is increased in size and resolution is increased, time for image data programming is increased and driving of the display device becomes difficult.

Such problems become more sever in displaying of a stereoscopic image. When the display device displays a stereoscopic image according to the national television system committee (NTSC) type, the display device should alternately display 60 frames of a left-eye image and 60 frames of a right-eye image in one second. Thus, the display device displaying a stereoscopic image requires two or more times driving frequency of a driving frequency of a display device displaying a general image.

Accordingly, a pixel having a structure that is appropriate for enlargement of a display panel, high-resolution, and displaying a stereoscopic image and can assure a sufficient aperture ratio.

Embodiments will be described more fully hereinafter with reference to the accompanying drawings. As those skilled in the art would realize, the described embodiments may be modified in various different ways, all without departing from the spirit or scope of the present invention.

Further, in various embodiments, like reference numerals designate like elements having the same configuration, a first embodiment is representatively described, and in other embodiments, and only a configuration different from the first embodiment will be described.

The drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

FIG. 1 is a block diagram of a display device according to an embodiment.

Referring to FIG. 1, a display device 10 includes a signal controller 100, a scan driver 200, a data driver 300, an initialization signal unit 400, a compensation control signal unit 500, a light emission signal unit 600, and a display unit 700.

The signal controller 100 receives an image signal Ims and a synchronization signal input from an external device. The input image signal ImS may include luminance information of a plurality of pixels. Luminance has a predetermined number of grays, for example, 1024 ($=2^{10}$), $256=2^8$), or $64=2^6$). The synchronization signal may include a horizontal synchronization signal Hsync, a vertical synchronization signal Vsync, and a main clock signal MCLK.

The signal controller 100 generates first to fifth driving control signals CONT1, CONT2, CONT3, CONT4, and CONT5 and an image data signal ImD according to the image signal ImS, the horizontal synchronization signal Hsync, the vertical synchronization signal Vsync, and the main clock signal MCLK.

In one embodiment, the signal controller 100 divides the image signal ImS per frame unit according to the vertical synchronization signal Vsync, and generates the image data signal ImD by dividing the image signal ImS per scan line unit according to the horizontal synchronization signal Hsync. The signal controller 100 transmits the image data signal ImD and the first driving control signal CONT1 to the data driver 300.

The display unit 700 is a display area including a plurality of pixels. In the display unit 700, a plurality of scan lines, a plurality of data lines, a plurality of data lines, a plurality of initialization lines, a plurality of compensation control lines, and a plurality of light emission lines are connected to a plurality of pixels. Here, the scan lines are substantially extended in a row direction and substantially parallel with each other and the data lines are substantially extended in a column direction and substantially parallel with each other. The pixels may be substantially arranged in a matrix format.

The scan driver 200 is connected to the scan lines, and generates a plurality of scan signals S[1] to S[n] according to the second driving control signal CONT2. The scan driver 200 may sequentially apply scan signals S[1] to S[n] of a gate-on voltage to the plurality of scan lines.

The data driver 300 is connected to the data lines, samples and holes the image data signal ImD input according to the first driving control signal CONT1, and transmits a plurality of data signals data[1]-data[m] to the plurality of data lines. The data driver 300 applies a data signal having a predetermined voltage range to the plurality of data lines corresponding to the scan signals S[1] to S[n] of the gate-on voltage.

The initialization signal unit 400 is connected to the initialization lines, and generates an initialization signal GI according to third driving control signal CONT3.

The compensation control signal unit 500 is connected to the compensation control lines, and generates a compensation control signal GC according to the fourth driving control signal CONT4.

The light emission signal unit 600 is connected to the light emission lines, and generates a light emission signal GE according to the fifth driving control signal CONT5.

Figure 2:
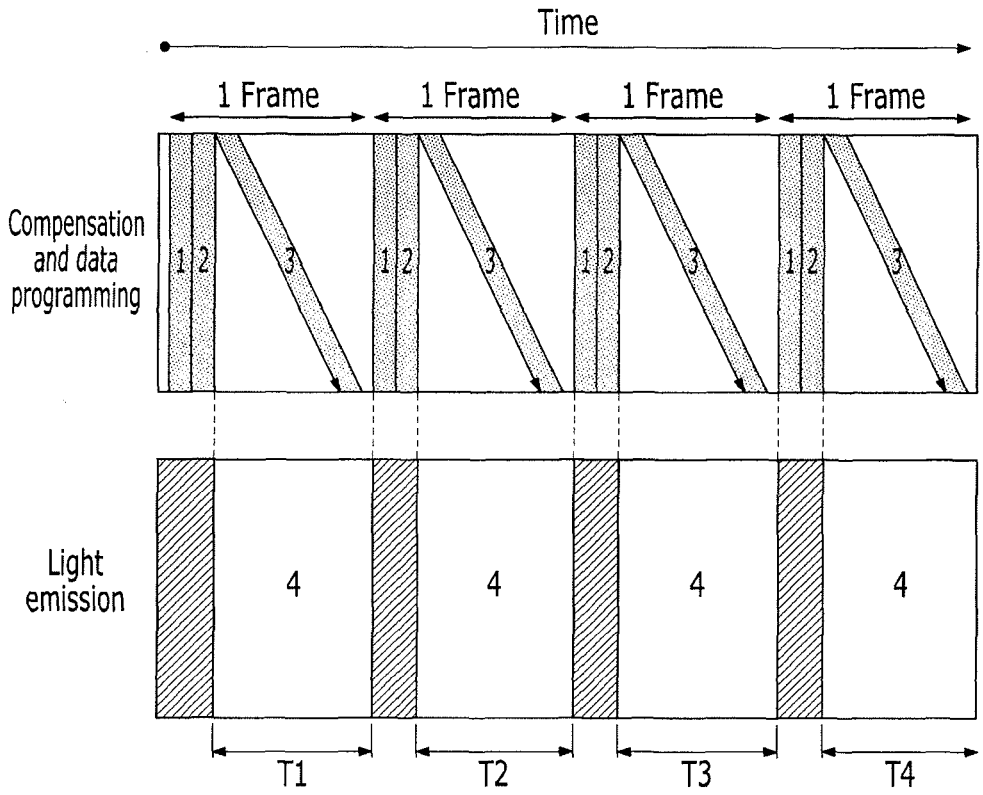
FIG. 2 shows a driving method of the display device according to one embodiment.

FIG. 2 shows a driving method of a display device according to one embodiment.

Referring to FIG. 2, one frame period during which a single image is displayed in the display unit 700 includes 1) an initialization period 1 for initializing a driving voltage of an organic light emitting diode of each pixel, 2) a compensation period 2 for compensating a threshold voltage of a driving transistor of each pixel, 3) a scan period 3 for programming data to the respective pixels, and 4) a light emission period 4 for light emission of the plurality of pixels corresponding to the programmed data. The scan period 3 and the light emission period 4 are temporally overlapped.

In a light emission period 4 of the present frame, pixels emit light according to data programmed during a scan period 3 of the previous frame. The pixels emit light during a light emission period 4 of the next frame according to data programmed to the pixels during the scan period 3 of the present frame.

For example, it is assumed that a period T1 includes a scan period 3 and a light emission period 4 of an N-th frame. Data programmed to the pixels during the scan period 3 of the period T1 is data of the N-th frame, and pixels emit light according to data of an (N−1)-th frame, programmed during a scan period 3 of the (N−1)-th frame during the light emission period 4 of the period T1.

A period T2 includes a scan period 3 and a light emission period 4 of the (N+1)-th frame. Data programmed to the pixels during the scan period 3 of the period T2 is data of the (N+1)-th frame, and the pixels emit light according to the data of the N-th frame, programmed during the scan period 3 of the N-th frame, that is, the period T1.

The period T3 includes a scan period 3 and a light emission period 4 of the (N+2)-th frame. Data programmed to the pixels during the scan period 3 of the period T3 is data of the (N+2)-th frame, and the pixels emit light according to the data of the (N+1)-th frame, programmed during the scan period 3 of the (N+1)-th frame, that is, the period T2.

A period T4 includes a scan period 3 and a light emission period 4 of the (N+3)-th frame. Data programmed to the pixels during the scan period 3 of the period T4 is data of the (N+3)-th frame, and the pixels emit light according to the data of the (N+2)-th frame, programmed during the scan period 3 of the (N+2)-th frame, that is, the period T3.

A pixel structure in which data of the present frame is programmed during the scan period 3 and light emission occurs according to data of the previous frame during a period overlapped with the scan period 3, that is, the light emission period 4 will be described with reference to FIG. 3.

Figure 3:
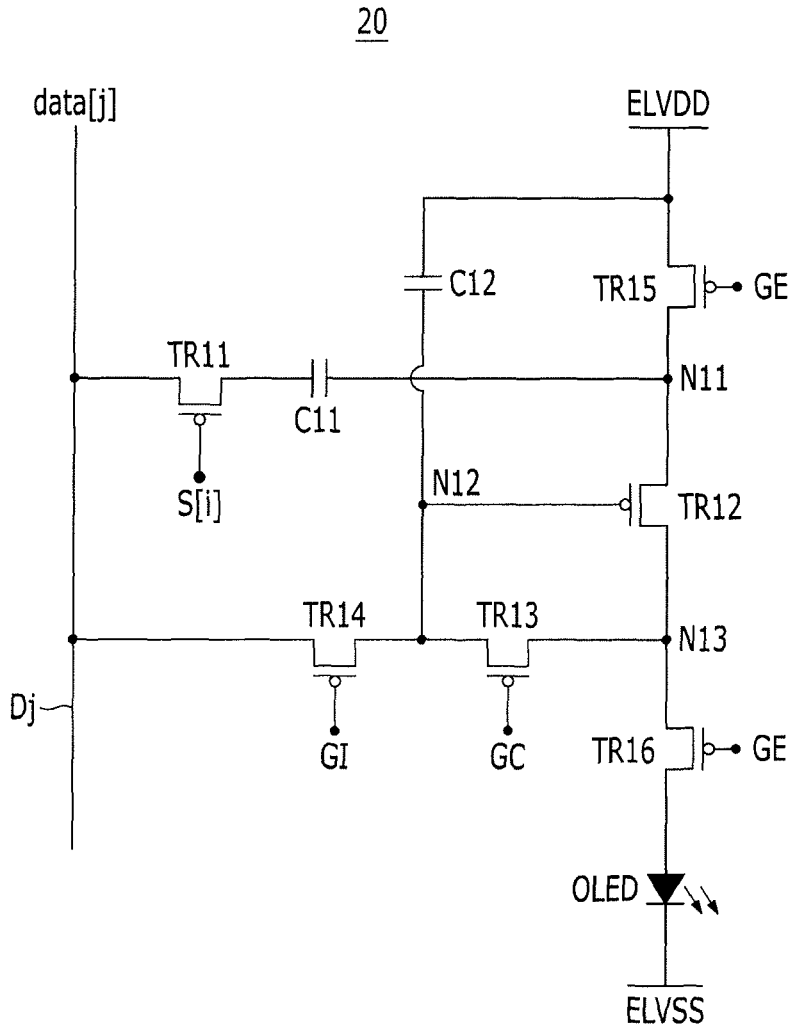
FIG. 3 is a circuit diagram of a pixel according to one embodiment.

FIG. 3 is a circuit diagram of the pixel according to one embodiment.

Referring to FIG. 3, a pixel 20 includes a switching transistor TR11, a driving transistor TR12, a compensation transistor TR13, a initialization transistor TR14, a first light emitting transistor TR15, a second light emitting transistor TR16, a first capacitor C11, a second capacitor C12, and an organic light emitting diode OLED.

The switching transistor TR11 includes a gate electrode connected to the scan line, a first electrode connected to a data line Dj, and a second electrode connected to a first electrode of the first capacitor C11. The switching transistor TR11 is turned on by the scan signal S[i] of the gate-on voltage applied to the scan line and thus transmits the data signal data[j] to the first capacitor C11 ($1 \leq i \leq n$, $1 \leq j \leq m$).

The driving transistor TR12 includes a gate electrode connected to a second node N12, a first electrode connected to a first node N11, and a second electrode connected to a third node N13. The driving transistor TR12 is turned on/off by a voltage of the second node N12 to control a driving current supplied to the organic light emitting diode OLED.

The compensation transistor TR13 includes a gate electrode connected to the compensation control line, a first electrode connected to the second node N12, and a second electrode connected to the second electrode of the driving transistor TR12. The compensation transistor TR13 is turned on by a compensation control signal GC of the gate-on voltage and thus connects the gate electrode and the second electrode to the driving transistor TR12.

The initialization transistor TR14 includes a gate electrode connected to the initialization line, a first electrode connected to the data line Dj, and a second electrode connected to the second node N12. The initialization transistor TR14 is turned on by an initialization signal GI of the gate-on voltage and thus transmits an initialization voltage Vinit applied to the data line Dj to the second node N12.

The first light emitting transistor TR15 includes a gate electrode connected to the light emission line, a first electrode connected to a first power source voltage ELVDD, and a second electrode connected to the first node N11.

The second light emitting transistor TR16 includes a gate electrode connected to the light emission line, a first electrode connected to the third node N13, and a second electrode connected to an anode of the organic light emitting diode OLED.

The first light emitting transistor TR15 and the second light emitting transistor TR16 are turned on by a light emission signal GE of the gate-on voltage, and transmit the current from the first power source voltage ELVDD to the organic light emitting diode OLED through the driving transistor TR12 in the turn-on state.

The first capacitor C11 includes a first electrode connected to the second electrode of the switching transistor TR11 and a second electrode connected to the first node N11.

The second capacitor C12 includes a first electrode connected to the second node N12 and a second electrode connected to the first power source voltage ELVDD.

The organic light emitting diode OLED includes an anode connected to the second electrode of the second light emitting transistor TR16 and a cathode connected to a second power source voltage ELVSS. The organic light emitting diode OLED emits light of one of primary colors. An example of the primary colors may include three primary colors such as red, green, and blue, and a desired color may be displayed by a spatial sum or a temporal sum of the three primary colors.

The switching transistor TR11, the driving transistor TR12, the compensation transistor TR13, the initialization transistor TR14, the first light emitting transistor TR15, and the second light emitting transistor TR16 may be p-channel field effect transistors. In this case, the gate-on voltage that turns on the switching transistor TR11, the driving transistor TR12, the compensation transistor TR13, the initialization transistor TR14, the first light emitting transistor TR15, and the second light emitting transistor TR16 is a logic low level voltage, and a gate-off voltage that turns of the transistors is a logic high level voltage.

Here, at least one of the switching transistor TR11, the driving transistor TR12, the compensation transistor TR13, the initialization transistor TR14, the first light emitting transistor TR15, and the second light emitting transistor TR16 may be an n-channel field effect transistor. In this case, a gate-on voltage turning on the n-channel field effect transistor is a logic high level voltage and a gate-off voltage turning of the transistor is a logic low level voltage.

The first power source voltage ELVDD is a logic high level voltage and the second power source voltage ELVSS is a logic low level voltage. The first power source voltage ELVDD and the second power source voltage ELVSS supply driving voltages for pixel operation.

Figure 4:
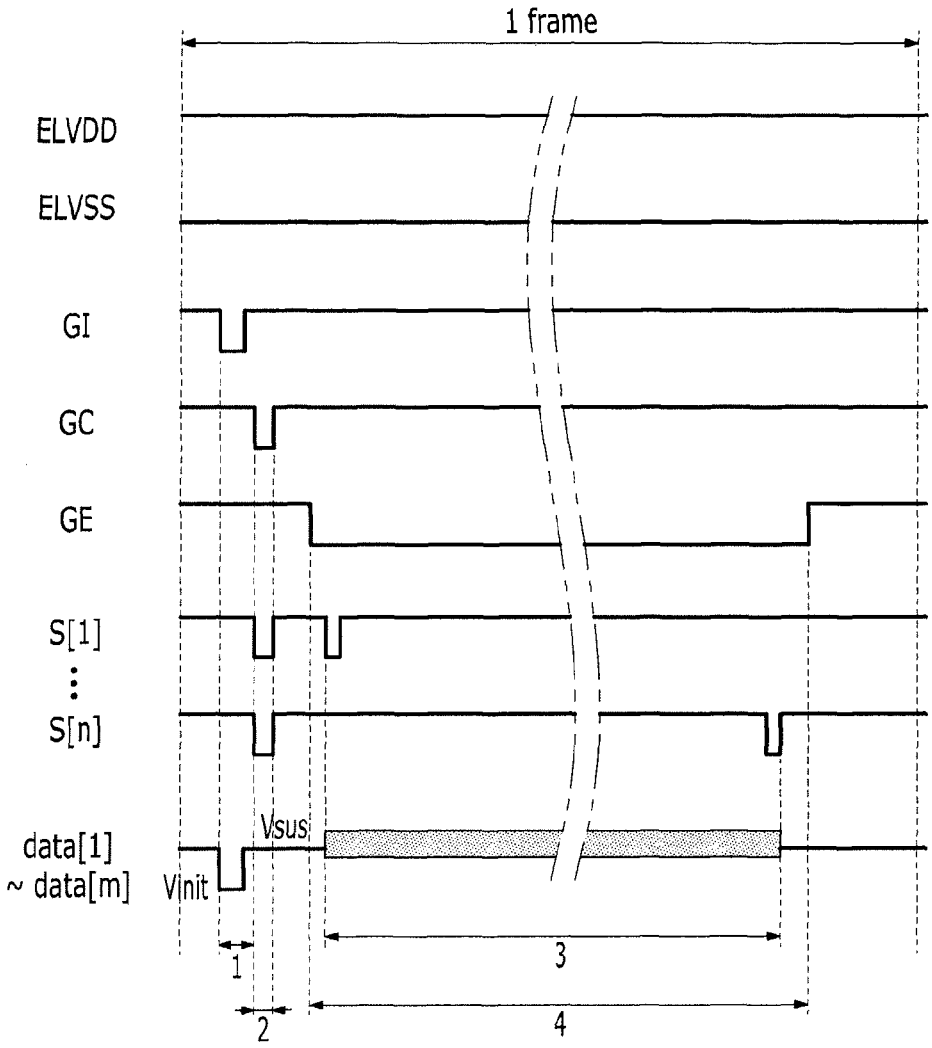
FIG. 4 is a timing diagram of the driving method of the display device according to one embodiment.

FIG. 4 is a timing diagram of a driving method of the display device according to one embodiment.

Referring to FIG. 3 and FIG. 4, a method for driving a display device including the pixel 20 will be described.

The first power source voltage ELVDD maintains logic high level and the second power source voltage ELVSS maintains logic low level during one frame. In addition, the scan signals S[1] to S[n[, the initialization signal GI, the compensation control signal GC, the light emission signal GE, and the data signals data[1] to data[m] are changed according to the reset period 1, the compensation period 2, the scan period 3, and the light emission period 4.

In the initialization period 1, the initialization signal GI is applied as a logic low level voltage. In this case, the data signals data[1] to data[m] are applied as the initialization voltage Vinit. The initialization transistor TR14 is turned on and the initialization voltage Vinit is transmitted to the second node N12 through the turned-on initialization transistor TR14. The initialization voltage Vinit is a low voltage for initialization of the voltage of the second node N12 to a sufficiently low voltage. The initialization voltage Vinit may be a logic low level voltage. When the voltage of the second node N12 is initialized by the initialization voltage Vinit, the initialization signal GI is converted to a logic high level voltage to turn off the initialization transistor TR14.

In the compensation period 2, the scan signals S[1] to S[n] and the compensation control signal GC are applied as a logic low level voltage. In this case, a sustain voltage Vsus having a predetermined voltage level is applied to the data line Dj. The sustain voltage Vsus may have the same voltage level of the initialization voltage Vinit. The switching transistor TR11 and the compensation transistor TR13 are turned on. As the sustain voltage Vsus is applied to the data line Dj and the switching transistor TR11 is turned on, a voltage stored in the first capacitor C11 is applied to the first node N11 with reference to the sustain voltage Vsus. The voltage stored in the first capacitor C11 is a voltage stored in the first capacitor 11 during the scan period 3 of the previous frame of the present frame, and is ELVDD−data. Data implies a voltage of the data signals data[1] to data[m]. A voltage transmitted to the first node N11 becomes ELVDD−data+Vsus. As the compensation transistor TR13 is turned on, the driving transistor TR12 is diode-connected and a voltage to which the threshold voltage Vth of the driving transistor TR12 is reflected is applied to the second node N12 and then stored in the second capacitor C12. A voltage Vg of the second node N12 is as shown in Equation 1.

$$Vg=\{\mathrm{Chold}/(\mathrm{Chold}+Cst)\}(ELVDD-\mathrm{data}-Vsus)+\{Cst/(\mathrm{Chold}+Cst)\}Vinit+[1+\{Cst/(\mathrm{Chold}+Cst)\}]Vth \quad \text{(Equation 1)}$$

Here, Chold denotes capacity of the first capacitor and Cst denotes capacity of the second capacitor. That is, the voltage Vg of the second node N12 is a voltage with reflection of the threshold voltage Vth of the driving transistor TR12 and the data voltage data of the previous frame.

The voltage to which the threshold voltage Vth of the driving transistor TR12 and the data voltage data of the previous frame are reflected is applied to the second node N12 and then stored in the second capacitor C12. After that, the compensation control signal GC is converted to a logic high level voltage and thus turns off the compensation transistor TR13.

In the light emission period 4, the light emission period GE is applied as a logic low level voltage to turn on the first light emitting transistor TR15 and the second light emitting transistor TR16. The first power source voltage ELVDD is transmitted to the first node N11 through the turned-on first light emitting transistor TR15. In addition, a current flows to the organic light emitting diode OLED through the driving transistor TR12. The driving current flowing to the organic light emitting diode OLED is as shown in Equation 2.

$$\begin{aligned} \text{I_OLED} &= k(Vgs - Vth)^2 \qquad \text{[Equation 2]} \\ &= k[\{Chold/(Chold + Cst)\}(ELVDD - \text{data} - Vsus) + \\ &\quad \{Cst/(Chold + Cst)\}Vinit + \\ &\quad [1 + \{Cst/(Chold + Cst)\}]Vth - ELVDD - Vth]^2 \\ &= k[\{Chold/(Chold + Cst)\}(ELVDD - \text{data} - Vsus) + \\ &\quad \{Cst/(Chold + Cst)\}Vinit - ELVDD + \\ &\quad \{Cst/(Chold + Cst)\}Vth]^2 \end{aligned}$$

The organic light emitting diode OLED emits light with brightness that corresponds to the driving current I_OLED. In Equation 2, the threshold voltage Vth of the driving transistor TR12 is scaled, and therefore the organic light emitting diode OLED emits light with brightness corresponding to a driving current I_OLED that is insignificantly influenced by a deviation of the threshold voltage Vth of the driving transistor TR12. Particularly, as a capacity Chold of the first capacitor C11 is larger than a capacity Cst of the second capacitor C12, much more current flows to the organic light emitting diode OLED with the same IC output range of the data driver 300, and the influence due to the deviation of the threshold voltage Vth of the driving transistor T12 can be reduced.

In the scan period 3, the plurality of scan signals S[1] to S[n] are sequentially applied as logic low level voltages to turn on the switching transistor TR11, and the plurality of data signals data[1] to data[m] are applied corresponding to the plurality of scan signals S[1] to S[n]. In this case, the first light emitting transistor TR15 is in the turn-on state and the first power source voltage ELVDD is applied to the first node N11. Thus, ELVDD-data voltage is stored in the first capacitor C11. That is, data is programmed to the plurality of pixels. The ELVDD-data voltage stored in the first capacitor C11 is used during a light emission period 4 of the next frame.

Figure 5:
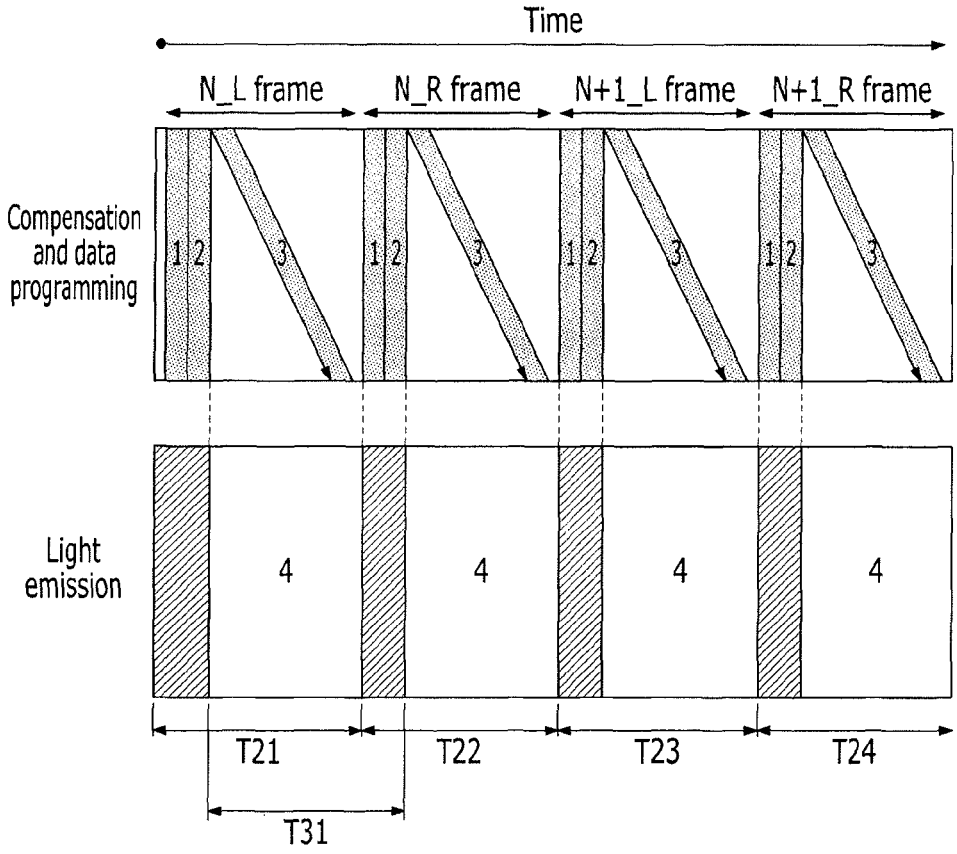
FIG. 5 shows a driving method of a display device according to another embodiment.

FIG. 5 shows a driving method of a display device according to another embodiment.

Referring to FIG. 5, a display device 10 alternately displays a left-eye image and a right-eye image according to a shutter glasses method. As shown in FIG. 5, each frame includes an initialization period 1, a compensation period 2, a scan period 3, and a light emission period 4.

A frame of which a plurality of data signals (hereinafter, referred to as left-eye image data signals) representing a left-eye image are programmed to a plurality of pixels is denoted using referential numeral "L", and a frame of which a plurality of data signals (hereinafter, referred to as right-eye image data signals) representing a right-eye image are programmed to the respective pixels is denoted using referential numeral "R".

In each of the initialization period 1, the compensation period 2, the scan period 3, and the light emission period 4, an initialization signal GI, a compensation control signal GC, a light emission signal GE, scan signals S[1] to S[n], and data signals data[1] to data[m] have the same waveforms of those shown in FIG. 4, and therefore no further description will be provided.

During a scan period 3 of a period T21, left-eye image data signals of an N_L frame are programmed to the plurality of pixels. During the scan period 3, a left-eye image data signal corresponding to each of the plurality of pixels is programmed. In this case, the plurality of pixels emit light according to a right-eye image data signal programmed during the scan period 3 of an N−1_R frame during a light emission period 4 of the period T21.

During a scan period 3 of a period T22, right-eye image data signals of the N_R frame are programmed to the plurality of pixels. That is, during the scan period, a right-eye image data signal corresponding to each of the plurality of pixels is programmed. In this case, the plurality of pixels emit light according to the left-eye image data signals programmed during the scan period 3 of the N_L frame during a light emission period 4 of the period T22.

During a scan period 3 of a period T23, left-eye image data signals of an N+1_L frame are programmed to the plurality of pixels. During the scan period 3, a left-eye image data signal corresponding to each of the plurality of pixels is programmed. In this case, the plurality of pixels emit light according to the right-eye image data signals programmed during the scan period 3 of the N_R frame during the light emission period 4 of the period T23.

During a scan period 3 of a period T24, right-eye image data signals of the N+1_R frame are programmed to the plurality of pixels. During the scan period 3, a right-eye image data signal corresponding to each of the plurality of pixels is programmed. In this case, the plurality of pixels emit light according to the left-eye image data signals programmed during the scan period 3 of the N+1_L frame.

With such a method, the right-eye image is simultaneously light-emitted while the left-eye image is programmed, and the left-eye image is simultaneously light-emitted while the right-eye image is programmed. Then, a sufficient light emission period can be assured, thereby improving image quality of a stereoscopic image.

Since the scan period 3 and the light emission period 4 are included in the same period, a gap T31 between light emission periods 4 of the respective frames can be set without regard to the scan period. In this case, a gap optimized in liquid crystal response speed of shutter glasses may be set as the gap T31 between the light emission period 4.

In a certain driving method, a scan period 3 and a light emission period 4 are not included in the same period. In this case, the light emission period 4 is provided after the scan period 3, and therefore a temporal margin for setting the light emission period 4 during one frame period is decreased. According to one embodiment, the light emission period 4 may be set during a period, excluding an initialization period and a compensation period during one frame period. Thus, the temporal margin for setting the light emission period 4 can be increased compared to the conventional case such that the gap T31 between the light emission periods 4 can be set in consideration with the liquid crystal response speed of the shutter glasses.

For example, the gap T31 between the light emission periods 4 may be set in consideration with a time consumed for completely opening right-eye lens (or, left-eye lens) of the shutter glasses from the end of light emission of the left-eye image (or, right-eye image).

Figure 6:
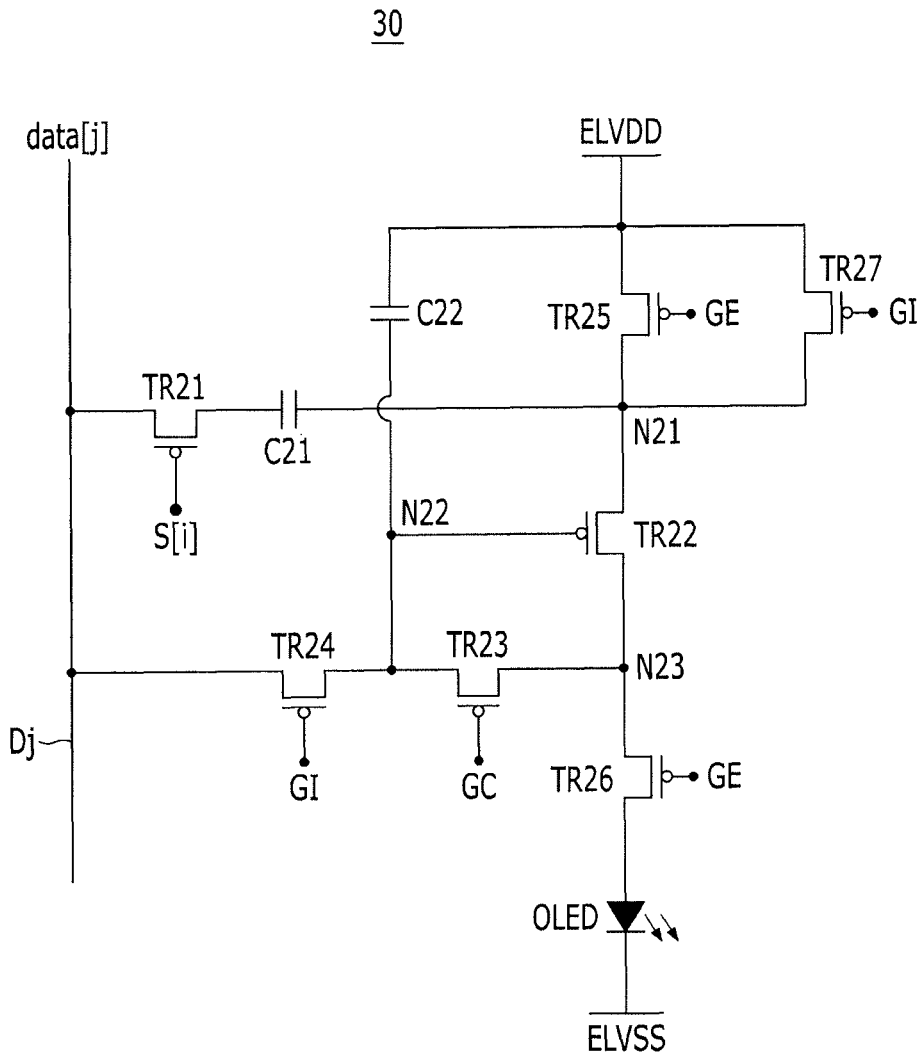
FIG. 6 is a circuit diagram of a pixel according to one embodiment.

FIG. 6 is a circuit diagram of a pixel according to another embodiment.

Referring to FIG. 6, a pixel 30 according to a second embodiment. includes a switching transistor TR21, a driving transistor TR22, a compensation transistor TR23, a first initialization transistor TR24, a first light emitting transistor TR25, a second light emitting transistor TR26, a second initialization transistor TR27, a first capacitor C21, a second capacitor C22, and an organic light emitting diode OLED.

Unlike the pixel 20 of the first embodiment, the pixel 30 of the second embodiment further includes a second initialization transistor TR27 including a gate electrode connected to an initialization line, a first electrode connected to a first power source voltage ELVDD, and a second electrode connected to a first node N21. The second initialization transistor TR27 is turned on by an initialization signal GI of a gate-on voltage and transmits a first power source voltage ELVDD to the first node N21. That is, when the initialization signal GI of the gate-on voltage is applied during an initialization period 1, the second initialization transistor TR27 initializes a voltage of the first node N21 to the first power source voltage ELVDD.

A display device including the pixel 30 according to the second embodiment is driven according to a timing diagram of FIG. 4. In addition, the display device including the pixel 30 of the second embodiment may be driven according to a driving method in that a left-eye image and a right-eye image are alternately displayed according to a shutter glasses method. Therefore, the method for driving the display device including the pixel 30 according to the second embodiment will not be further described.

Figure 7:
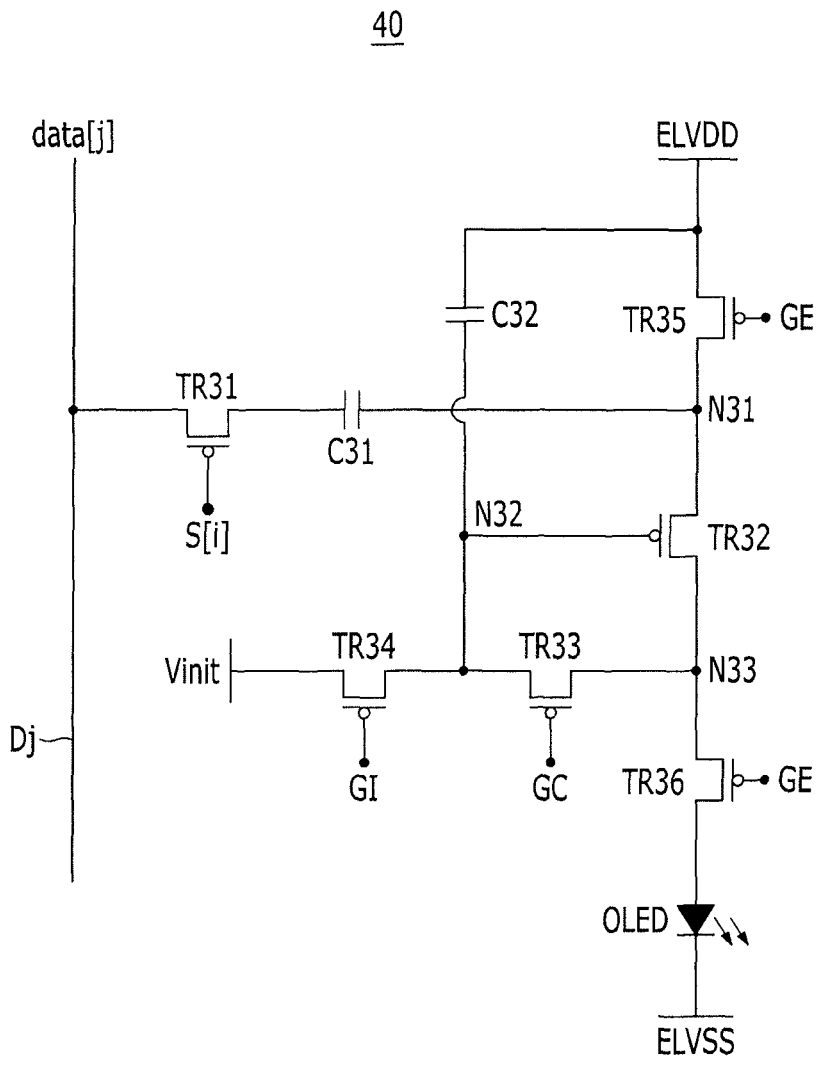
FIG. 7 is a circuit diagram of a pixel according to another embodiment.

FIG. 7 is a circuit diagram of a pixel according to a third embodiment.

Referring to FIG. 7, a pixel 40 according to the third embodiment includes a switching transistor TR31, a driving transistor TR32, a compensation transistor TR33, an initialization transistor TR34, a first light emitting transistor TR35, a second light emitting transistor TR36, a first capacitor C31, a second capacitor C32, and an organic light emitting diode OLED.

Unlike the pixel 20 of the first embodiment, the initialization transistor TR34 included in the pixel 40 according to the third embodiment of the present invention includes a gate electrode connected to an initialization line, a first electrode connected to an initialization voltage Vinit, and a second electrode connected to a second node N32. The initialization transistor TR34 is turned on by an initialization signal GI of a gate-on voltage and transmits the initialization voltage Vinit to the second node N32. That is, in the pixel 40 of the third embodiment, an initialization voltage Vinit is separately provided without through a data line Dj to initialize the voltage of the second node N32 to the initialization voltage Vinit during an initialization period 1.

Figure 8:
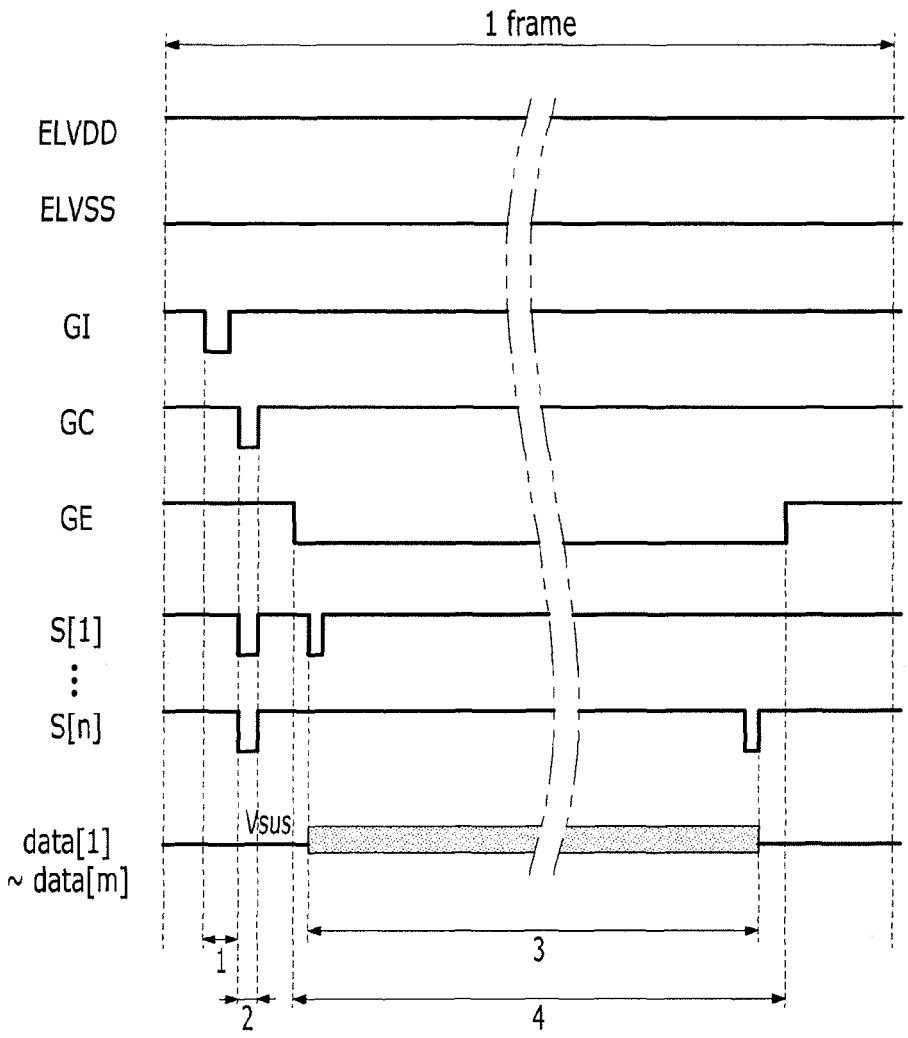
FIG. 8 is a timing diagram of a driving method of a display device according to another embodiment.

FIG. 8 is a timing diagram of a driving method of a display device according to another embodiment.

FIG. 7 and FIG. 8 are timing diagrams of the driving method of the display device including the pixel 40 according to the third embodiment. The initialization transistor TR34 of the pixel 40 according to the third embodiment is connected to the separately provided initialization voltage Vinit, and therefore the data signals data[1] to data[m] may be maintained with a sustain voltage Vsus without being converted into the initialization voltage Vinit during the initialization period 1.

Since waveforms of an initialization signal GI, a compensation signal GC, a light emission signal GE, scan signals S[1] to S[n], and data signals data[1] to data[m] in each of the initialization period, the compensation period, the scan period 3, and the light emission period 4 are the same as those of FIG. 4, and therefore each period will not be further described.

The display device including the pixel 40 according to the third embodiment may be driven according to the driving method in which the left-eye image and the right-eye image are alternately displayed according to the shutter glasses method described with reference to FIG. 5.

Figure 9:
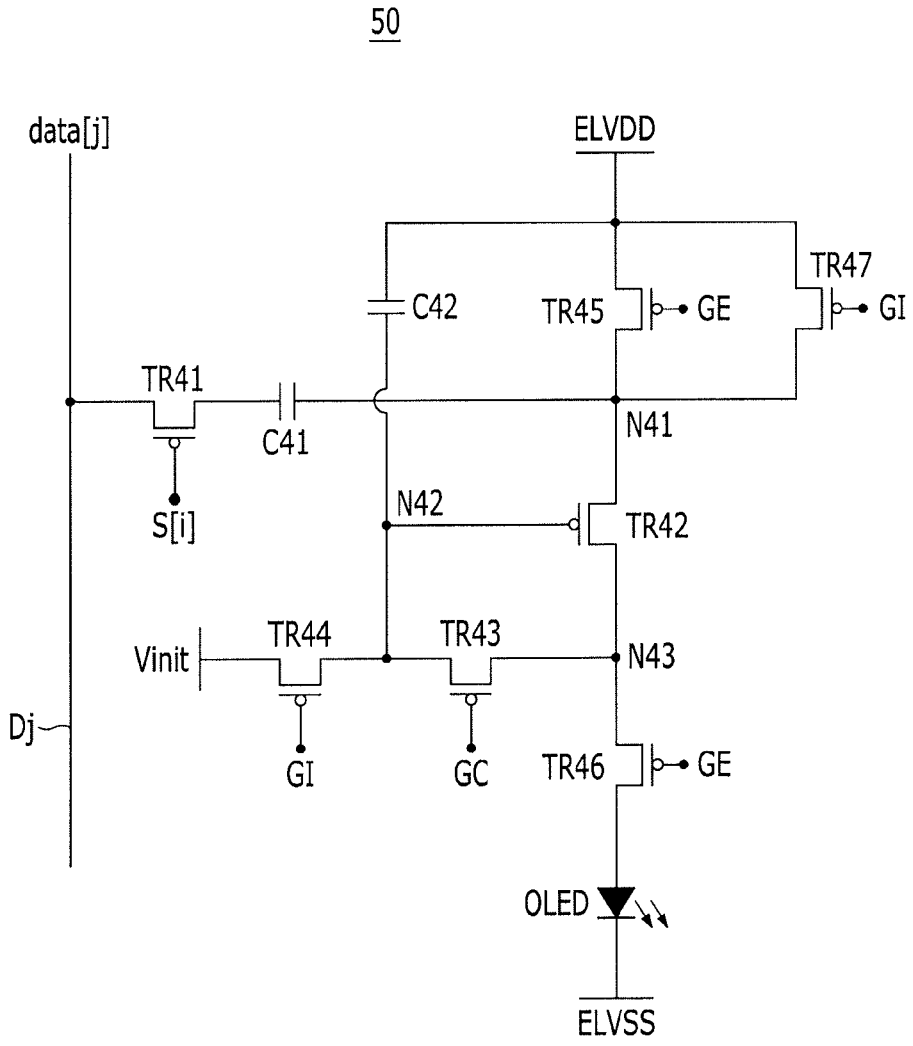
FIG. 9 is a circuit diagram of a pixel according to one embodiment.

FIG. 9 is a circuit diagram of a pixel according to another embodiment.

Referring to FIG. 9, a pixel 50 according to a fourth embodiment includes a switching transistor TR41, a driving transistor TR42, a compensation transistor TR43, a first initialization transistor TR44, a first light emitting transistor TR45, a second light emitting transistor TR46, a second initialization transistor TR47, a first capacitor C41, a second capacitor C42, and an organic light emitting diode OLED.

Unlike the pixel 40 of the third embodiment, the pixel 50 of the fourth embodiment further includes a second initialization transistor TR47 including a gate electrode connected to an initialization line, a first electrode connected to a first power source voltage ELVDD, and a second electrode connected to a first node N41. The second initialization transistor TR47 is turned on by an initialization signal GI of a gate-on signal and thus transmits the first power source voltage ELVDD to the first node N41. That is, when the initialization signal GI of the gate-on voltage is applied during an initialization period 1, a voltage of the first node N41 is initialized to the first power source voltage ELVDD.

A display device including the pixel 50 of the fourth embodiment is driven according to the timing diagram of FIG. 8. In addition, the display device including the pixel 50 of the fourth embodiment may be driven according to the driving method in that a left-eye image and a right-eye image are alternately displayed according to a shutter glasses method. Therefore, the method for driving the display device including the pixel 50 according to the fourth embodiment will not be further described.

As described above, in the pixel, the voltage ELVDD-data stored in the first capacitor 11 is applied to the first node N11 with reference to an arbitrary sustain voltage Vsus supplied to the data line, and therefore a voltage having an appropriate range for the first power source voltage LEVDD may be applied to the first node N11 by controlling a level of the sustain voltage Vsus in the compensation period 2 even though an output range of the driving IC of the data driver 300 is fixed. Accordingly, the pixel has advantages in gray expression and luminance improvement.

In addition, since the pixel uses the data line designed to have equivalent resistance without using an additional power source like a reference voltage, non-uniformity in the screen due to the reference voltage line can be prevented, and accordingly, stable and uniform screen display can be achieved.

In addition, since the data programming and the light emission are simultaneously performed in the pixel, sufficient data programming time can be assured so that the pixel can be appropriate for an enlarged and high-resolution display panel and can assure a sufficient aperture ratio by using two capacitors.

At least one of the disclosed embodiments enables enlargement of a display panel, high-resolution, and displaying of a stereoscopic image, and can assure a sufficient aperture ratio.

The above embodiments are for illustrative purpose only and not to restrict the meanings or limit the scope of the present invention. Therefore, those skilled in the art can understand that various modifications and other equivalent embodiment may be made without departing from the spirit and scope of the accompanying claims.

What is claimed is:

1. An organic light emitting diode (OLED) display device comprising:

a plurality of pixels, each including 1) a driving transistor configured to control a driving current supplied to an OLED, 2) a first capacitor operatively connected to a first electrode of the driving transistor, 3) a switching transistor configured to connect the first capacitor and a data line, and 4) a first light emission transistor configured to transmit a first power source voltage to the first electrode of the driving transistor, wherein, when light emission of the OLED with application of the first power source voltage through the first light emission transistor to the first electrode of the driving transistor is simultaneously occurred in each of the pixels, a scan signal of a gate-on voltage is configured to be applied to the corresponding pixel and thus the corresponding data voltage is configured to be stored in the first capacitor, and wherein the data voltage stored in the first capacitor is configured to be applied to the previous frame of the present frame.

2. The display device of claim 1, wherein each of the pixels further comprises a compensation transistor configured to connect a gate electrode and a second electrode of the driving transistor.

3. The display device of claim 2, wherein each of the pixels further comprises an initialization transistor operatively connected to the gate electrode of the driving transistor.

4. The display device of claim 3, wherein each of the pixels further comprises a second light emission transistor operatively connected between the second electrode of the driving transistor and an anode of the OLED.

5. The display device of claim 4, wherein the initialization transistor comprises a gate electrode to which the initialization signal is input, a first electrode operatively connected to a data line, and a second electrode operatively connected to the gate electrode of the driving transistor.

6. The display device of claim 5, wherein when an initialization signal of a gate-on voltage is applied to the gate electrode of the initialization transistor, an initialization voltage is configured to be applied to the data line.

7. The display device of claim 6, wherein each of the pixels further comprises a second initialization transistor including 1) a gate electrode to which the initialization signal is applied, 2) a first electrode operatively connected to the first power source voltage, and 3) a second electrode operatively connected to the first electrode of the driving transistor.

8. The display device of claim 4, wherein the initialization transistor comprises 1) a gate electrode to which the initialization signal is input, 2) a first electrode to which an initialization voltage is applied, and 3) a second electrode connected to the gate electrode of the driving transistor.

9. The display device of claim 8, further comprising a second initialization transistor including 1) a gate electrode to which the initialization signal is applied, 2) a first electrode connected to the first power source voltage, and 3) a second electrode connected to the first electrode of the driving transistor.

10. The display device of claim 5, wherein, when a compensation control signal of a gate-on voltage is applied to the gate electrode of the compensation transistor, a sustain voltage is configured to be applied to the data line and a scan signal of a gate-on voltage is configured to be applied to the gate electrode of the switching transistor so that the data voltage stored in the first capacitor is transmitted to the first electrode of the driving transistor with reference to the sustain voltage.

11. The display device of claim 10, wherein each of the pixels further comprises a second capacitor operatively connected between the gate electrode of the driving transistor and the first power source voltage.

12. The display device of claim 11, wherein the compensation transistor is configured to be turned on, and a threshold voltage of the driving transistor and a voltage to which the data voltage of the previous frame is reflected are configured to be stored in the second capacitor.

13. A method for driving an organic light emitting diode (OLED) display device including a plurality of pixels, each including a driving transistor controlling a driving current supplied to an OLED, a first capacitor operatively connected to a first electrode of the driving transistor, a switching transistor operatively connecting the first capacitor and the data line, a first light emission transistor transmitting a first power source voltage to the first electrode of the driving transistor, and a second capacitor operatively connected between the gate electrode of the driving transistor and the first power source voltage, comprising storing a data voltage in the first capacitor by applying a scan signal of a gate-on voltage to a gate electrode of the switching transistor and emitting light from the OLED according to a driving current flowing to the driving transistor based at least in part on a voltage stored in the second capacitor, wherein the respective pixels substantially simultaneously emit light, and wherein the storing and emitting are temporally overlapped with each other.

14. The method for driving the display device of claim 13, wherein the emitting comprises turning on a first light emission transistor that transmits the first power source voltage to a first electrode of the driving transistor and turning on a second light emission transistor operatively connected between a second electrode of the driving transistor and an anode of the OLED.

15. The method for driving the display device of claim 13, further comprising transmitting an initialization voltage to a gate electrode of the driving transistor by applying an initialization signal of a gate-on voltage to a gate electrode of an initialization transistor operatively connected to the gate electrode of the driving transistor.

16. The method for driving the display device of claim 15, wherein the initialization transistor comprises a first electrode operatively connected to the data line and a second electrode operatively connected to the gate electrode of the driving transistor, and when an initialization signal of a gate-on voltage is applied to the gate electrode of the initialization transistor, the initialization voltage is applied to the data line.

17. The method for driving the display device of claim 16, wherein the transmitting comprises turning on a second initialization transistor that includes a gate electrode to which the initialization signal is applied, a first electrode operatively connected to the first power source voltage, and a second electrode operatively connected to the first electrode of the driving transistor.

18. The method for driving the display device of claim 15, wherein the initialization transistor comprises a first electrode to which the initialization voltage is applied and a second electrode operatively connected to the gate electrode of the driving transistor, and an initialization signal of a gate-on voltage is applied to the gate electrode of the initialization transistor.

19. The method for driving the display device of claim 18, wherein the transmitting comprises turning on a second initialization transistor including a gate electrode to which the initialization signal is applied, a first electrode operatively connected to the first power source voltage, and a second electrode operatively connected to the first electrode of the driving transistor.

20. The method for driving the display device of claim 13, further comprising compensating a threshold voltage of the driving transistor by applying a compensation control voltage of a gate-on voltage to a gate electrode of a compensation transistor that operatively connects the gate electrode and the second electrode of the driving transistor.

21. The method for driving the display device of claim 20, wherein when a compensation control signal of a gate-on voltage is applied to the gate electrode of the compensation transistor, a sustain voltage is applied to the data line and a scan signal of a gate-on voltage is applied to the gate electrode of the switching transistor so that a data voltage stored in the first capacitor is transmitted to the first electrode of the driving transistor with reference to the sustain voltage.

22. The method for driving the display device of claim 21, wherein the data voltage stored in the first capacitor is applied in the previous frame of the present frame.

23. The method for driving the display device of claim 22, wherein the compensating comprises turning on the compensation transistor and storing a voltage to which a threshold voltage of the driving transistor and a voltage to which the data voltage of the previous frame is reflected are stored in the second capacitor.

24. A pixel comprising:

a switching transistor including a gate electrode to which a scan signal is applied and a first electrode connected to a data line;

a first capacitor including a first electrode operatively connected to a second electrode of the switching transistor and a second electrode operatively connected to a first node, wherein a data voltage stored in the first capacitor is configured to be applied to the previous frame of the present frame;

a driving transistor including a gate electrode operatively connected to a second node, a first electrode operatively connected to the first node, and a second electrode operatively connected to a third node;

a compensation transistor including a gate electrode to which a compensation control signal is applied, a first electrode operatively connected to the second node, and a second electrode operatively connected to the third node;

an initialization transistor configured to transmit an initialization voltage to the second node according to an initialization signal; and a second capacitor including a first electrode operatively connected to the second node and a second electrode operatively connected to a first power source voltage.

25. The pixel of claim 24, further comprising:

a first light emission transistor including a gate electrode to which a light emission signal is applied, a first electrode operatively connected to the first power source voltage, and a second electrode operatively connected to the first node; and a second light emission transistor including a gate electrode to which the light emission signal is applied, a first electrode operatively connected to the third node, and a second electrode operatively connected to an anode of an organic light emitting diode.

26. The pixel of claim 25, wherein the initialization transistor comprises a gate electrode to which the initialization signal is applied, a first electrode operatively connected to the data line, and a second electrode operatively connected to the second node.

27. The pixel of claim 26, further comprising a second initialization transistor including a gate electrode to which the initialization signal is applied, a first electrode operatively connected to the first power source voltage, and a second electrode operatively connected to the first node.

28. The pixel of claim 25, wherein the initialization transistor comprises a gate electrode to which the initialization signal is applied, a first electrode operatively connected to an initialization voltage, and a second electrode operatively connected to the second node.

29. The pixel of claim 28, further comprising a second initialization transistor including a gate electrode to which the initialization signal is applied, a first electrode operatively connected to the first power source voltage, and a second electrode operatively connected to the first node.

* * * * *